US005320041A

United States Patent [19]

Maejima et al.

[11] Patent Number: 5,320,041

[45] Date of Patent: Jun. 14, 1994

[54] PLATE MOUNTED STATE CONFIRMING APPARATUS

[75] Inventors: Kazuhiro Maejima; Takeshi Asai, both of Ibaragi, Japan

[73] Assignee: Komori Corporation, Japan

[21] Appl. No.: 14,384

[22] Filed: Feb. 5, 1993

[30] Foreign Application Priority Data

Feb. 10, 1992 [JP] Japan ..... 4-56615

[51] Int. Cl.[5] ..... B41F 1/28

[52] U.S. Cl. ..... 101/415.1; 101/486; 33/621

[58] Field of Search ..... 101/378, 383, 384, 415.1, 101/485, 486, 481; 33/614, 617, 619, 620, 621

[56] References Cited

U.S. PATENT DOCUMENTS 4,603,641 8/1986 Jeschke et al. ..... 101/415.1

FOREIGN PATENT DOCUMENTS 2166084 4/1986 United Kingdom ..... 101/415.1

*Primary Examiner*—Edgar S. Burr
*Assistant Examiner*—Christopher A. Bennett
*Attorney, Agent, or Firm*—Blakely, Sokoloff, Taylor & Zafman

[57] ABSTRACT

A plate mounted state confirming apparatus includes reference pins, a transmitting coupler, and a receiving coupler. The reference pins detect contact of an insertion end of a plate inserted in a gripper portion of a plate lockup device provided in a gap formed in an outer circumferential surface of a plate cylinder in an axial direction thereof. The transmitting coupler outputs a detection signal obtained by the reference pins as an electrical signal from a plate cylinder. The receiving coupler receives the electrical signal from the transmitting coupler outside the plate cylinder in a non-contact manner.

3 Claims, 2 Drawing Sheets

PLATE MOUNTED STATE CONFIRMING APPARATUS

BACKGROUND OF THE INVENTION

The present invention relates to a plate mounted state confirming apparatus for a printing press, which confirms whether or not a plate is mounted on a plate cylinder with a high precision.

In each of various types of printing presses, leading- and trailing-side plate lockup devices are provided in a gap formed in the outer circumferential surface of a plate cylinder. When the leading end of a plate is gripped by the leading-side plate lockup device, the plate cylinder is rotated by almost one revolution, thereby winding the plate on the circumferential surface of the plate cylinder. Thereafter, the trailing end of the plate is gripped by the trailing-side plate lockup device, and the plate is mounted on the plate cylinder.

In the printing operation, an ink and water are supplied to the surface of the mounted plate to form an image, and the image is transferred to paper being transported directly or through a blanket cylinder, thereby printing the image.

In this printing operation, when the plate is distortedly mounted, the image is distortedly printed, degrading the quality of the printed matter. Especially, in multicolor printing, the different colors are misregistered to largely degrade the quality of the printed matter.

For this reason, conventionally, U-shaped reference pin holes are formed in the leading end face of the plate with reference to reference holes formed in the plate during plate making. The plate is mounted while engaging the reference pin holes with reference pins provided on the gripper portion of the leading-side plate lockup device.

More specifically, the gripper plate of the leading-side plate lockup device is opened, the leading end of the plate is inserted in the gripper portion of the gripper plate, the U-shaped bottom portions (insertion end) of the reference pin holes are abutted against the reference pins, this abutted state is confirmed according to the visual observation of the operator, and the gripper plate is closed.

However, with this plate mounting method, since abutment of the reference pin holes with the reference pins is confirmed according to the visual observation of the operator, variations are caused depending on different operators, and satisfactory positioning precision cannot always be obtained.

Therefore, recently, the present applicant proposed a method of confirming abutment of the reference pin holes against the reference pins. According to this method, the reference pins serve as electrodes. Contact of the insertion end with the reference pins is detected, and a detection result is obtained in the form of an electrical signal. This electrical signal is received outside the plate cylinder (at an external portion of the plate cylinder) through a signal transmitting means having a contact type contact structure employing, e.g., a brush scheme. A display is turned on based on the received electrical signal.

With this method, however, since the signal transmitting means for receiving the electrical signal has the contact type contact structure, incomplete contact tends to occur due to a degradation in conductivity or the like caused by an oxide formed by electric spark.

SUMMARY OF THE INVENTION

It is an object of the present invention to provide a plate mounted state confirming apparatus capable of receiving a plate mounted state signal sent from a plate cylinder without causing incomplete contact.

According to the present invention, there is provided a plate mounted state confirming apparatus comprising insertion end detecting means for detecting contact of an insertion end of a plate inserted in a gripper portion of a plate lockup device provided in a gap formed in an outer circumferential surface of a plate cylinder in an axial direction thereof, signal output means for outputting a detection signal obtained by the insertion end detecting means as an electrical signal from a plate cylinder, and signal receiving means for receiving the electrical signal from the signal output means outside the plate cylinder in a non-contact manner.

DESCRIPTION OF THE PREFERRED EMBODIMENTS

Preferred embodiments of plate mounted state confirming apparatuses according to the present invention will be described in detail with reference to the accompanying drawings.

Figure 1:
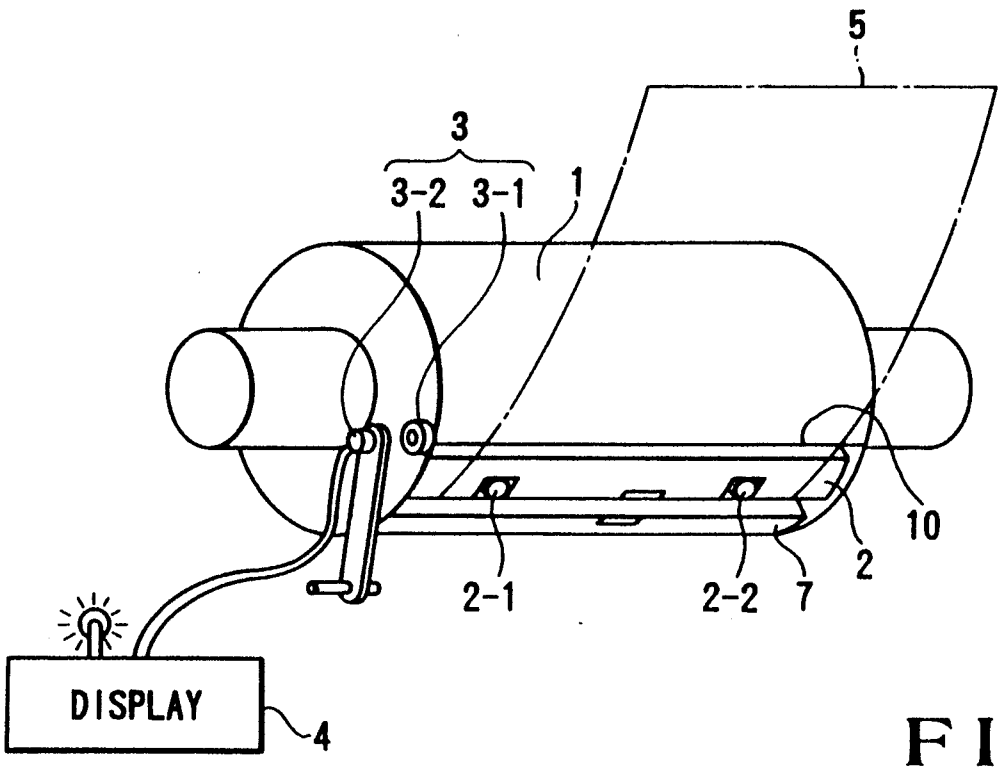
FIG. 1 is a schematic view showing a plate mounted state confirming apparatus according to an embodiment of the present invention.
Figure 2:
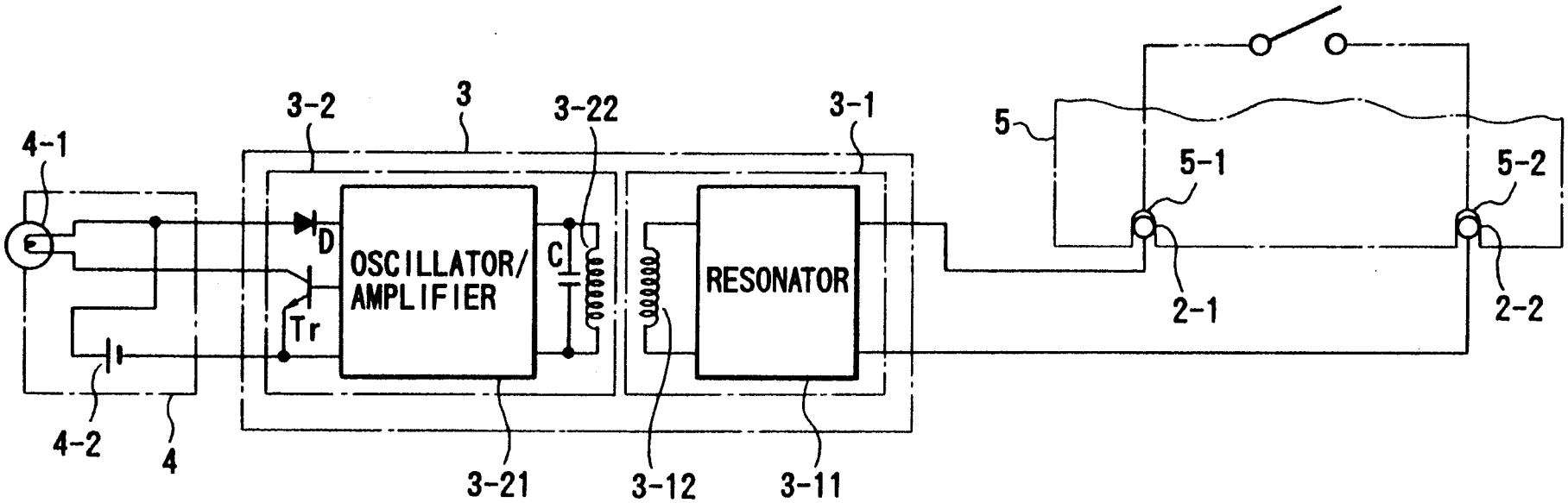
FIG. 2 is an electrical circuit diagram of the plate mounted state confirming apparatus of FIG. 1.

FIG. 1 shows this plate mounted state confirming apparatus, and FIG. 2 shows the electrical connection of this plate mounted state confirming apparatus.

Referring to FIGS. 1 and 2, reference numeral 1 denotes a plate cylinder; 2, a leading-side plate lockup device provided in a gap 10 formed in the circumferential surface of the plate cylinder 1 in the axial direction thereof; 2-1 and 2-2, a pair of left and right reference pins provided on the gripper portion of the leading-side plate lockup device 2; 3, a signal transmitting means for transmitting a signal from the plate cylinder 1 to the frame; 4, a display; 5, a plate having a pair of U-shaped reference pin holes to be engaged with the reference pins 2-1 and 2-2, and to be mounted on the circumferential surface of the plate cylinder 1; and 7, a trailing-side plate lockup device provided in the gap 10 to be parallel to the leading-side plate lockup device 2.

In this embodiment, a non-contact type transmission coupler is used as the signal transmitting means 3. The non-contact type transmission coupler 3 comprises a transmitting coupler 3-1 arranged on the plate cylinder 1 and a receiving coupler 3-1 arranged on the frame outside the plate cylinder 1.

The positional relationship between the transmitting and receiving couplers 3-1 and 3-2 is determined such that the transmitting and receiving couplers 3-1 and 3-2 rotatably oppose each other when the plate cylinder 1 is at a predetermined angular position, i.e., at an angular position predetermined as the plate mounting position.

The reference pins 2-1 and 2-2 are connected to the transmitting coupler 3-1, and the display 4 is connected to the receiving coupler 3-2. The transmitting coupler 3-1 has a resonator 3-11 connected to the reference pins 2-1 and 2-2 and a coil 3-12 connected to the resonator 3-11. The receiving coupler 3-2 has an oscillator/amplifier 3-21, a coil 3-22 connected to the oscillator/amplifier 3-21, a capacitor C connected in parallel with the coil 3-22, a diode D connected to a power supply path to the oscillator/amplifier 3-21, and a transistor Tr for driving the display 4 by an output from the oscillator-/amplifier 3-21.

Note that the display 4 has a lamp 4-1 and a power supply 4-2, and the power supply 4-2 serves as the power supply to the lamp 4-1 and the power supply to the receiving coupler 3-2.

According to the plate mounted state confirming apparatus having the arrangement as described above, when the plate cylinder 1 is stopped at an angular position as the plate mounting position (plate insertion phase), the non-contact type transmission coupler 3 is set in a transmission enable state.

In this state, when the plate 5 is set in the leading-side plate lockup device 2, as indicated by a long and short dashed line in FIG. 1 and a long and two short dashed line in FIG. 2, i.e., when the U-shaped bottom portions (insertion end) of reference pin holes 5-1 and 5-2 formed in the end face of the leading end of the plate 5 are abutted against the reference pins 2-1 and 2-2, the conductive leading end of the plate 5 serves as a switch by using the reference pins 2-1 and 2-2 as the electrodes due to contact of the insertion end, and the path between the reference pins 2-1 and 2-2 is closed.

In plate mounting, the coil 3-12 of the transmitting coupler 3-1 and the coil 3-22 of the receiving coupler 3-2, which couplers 3-1 and 3-2 constituting the non-contact type transmission coupler 3, are electromagnetically coupled to each other. Hence, when the path between the reference pins 2-1 and 2-2 is closed to constitute a closed loop in the transmission coupler 3-1, an induced current is caused in the closed loop of the transmitting coupler 3-1 due to the magnetic field generated in the coil 3-22 of the receiving coupler 3-2.

A power loss in the receiving coupler 3-2 is increased by this induced current, the transistor Tr that detected the power loss is turned on, and the lamp 4-1 is turned on in the display 4.

In this manner, according to the plate mounted state confirming apparatus of this embodiment, since the electrical signal from the plate cylinder 1 is received outside the plate cylinder 1 in the non-contact manner by using the non-contact type transmission coupler 3, no electric spark occurs, and incomplete contact will not be caused.

In this embodiment, the non-contact type transmission coupler is used as the signal transmitting means 3. However, it is apparent that the present invention is not limited to this.

Figure 3:
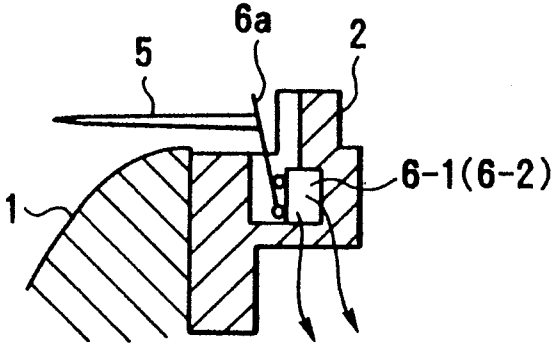
FIG. 3 is a sectional side view, showing the main part of a leading-side plate lockup device of a plate mounted state confirming apparatus according to another embodiment of the present invention, for describing detection of contact of an insertion end of a plate.

In this embodiment, contact of the insertion end of the plate 5 is detected by using the reference pins 2-1 and 2-2 as the electrodes. However, the reference pins 2-1 and 2-2 need not be used as the electrodes. For example, as shown in FIG. 3, in place of the reference pins 2-1 and 2-2, actuators 6*a* of limit switches 6-1 and 6-2 may be arranged parallel to each other on the side of a leading-side plate lockup device where the plate 5 is inserted. The insertion end of the plate 5 acts on the actuators 6*a* when it is engaged with reference pins 2-1 and 2-2. The limit switches 6-1 and 6-2 may be turned on by the operation of the actuators 6*a*, thereby detecting the mounted state of the insertion end of the plate 5.

As is apparent from the above description, according to the present invention, since the electrical signal from the plate cylinder is received outside the plate cylinder in the non-contact manner, electric spark and the like are not accompanied, and incomplete contact will not be caused.

What is claimed is:

1. A plate mounted state confirming apparatus comprising:

a plate cylinder having a circumferential surface on which a plate is mounted;

a gap formed in the circumferential surface of said plate cylinder in an axial direction thereof;

a plate lockup device provided in said gap;

detecting means for detecting an insertion of a reading end of the plate in a gripper portion of said plate lockup device;

signal output means provided on said plate cylinder, for outputting a detection signal obtained by said detecting means as an electromagnetic signal, said signal output means comprising a first coil and a resonator having an input connected to said first coil and an output connected to said detecting means; and signal receiving means provided on a frame outside said plate cylinder, for receiving the electromagnetic signal from said signal output means in a non-contact manner, said signal receiving means comprising an oscillator for generating an oscillation output, a second coil electromagnetically coupled to said first coil and energized by the oscillation output from said oscillator, and an amplifier means for detecting a power loss caused in said second coil;

wherein said first coil and said second coil oppose each other when said plate cylinder is stopped at a predetermined angular position as a plate mounting position.

2. An apparatus according to claim 1, further comprising display means for displaying and confirming a plate mounted state in accordance with an operation of said amplifier means of said signal receiving means.

3. An apparatus according to claim 1, wherein said detecting means comprises a pair of reference pins provided on the gripper portion of said plate lockup device and a pair of reference pin holes formed in the leading end of the plate, respectively, corresponding to said reference pins, and detects that said reference pins are electrically connected to each other via the reading end of the plate being conductive by engaging bottom portion of said reference pin holes with said reference pins.

* * * * *